US009233737B2

(12) United States Patent
Bruce

(10) Patent No.: US 9,233,737 B2
(45) Date of Patent: Jan. 12, 2016

(54) OFFSHORE MARINE ANCHOR

(75) Inventor: Peter Bruce, Douglas (GB)

(73) Assignee: BruPat Limited (IM)

( * ) Notice: Subject to any disclaimer, the term of this patent is extended or adjusted under 35 U.S.C. 154(b) by 106 days.

(21) Appl. No.: 13/641,492

(22) PCT Filed: Apr. 13, 2011

(86) PCT No.: PCT/GB2011/050736

§ 371 (c)(1),
(2), (4) Date: Oct. 16, 2012

(87) PCT Pub. No.: WO2011/128689

PCT Pub. Date: Oct. 20, 2011

(65) Prior Publication Data

US 2013/0032077 A1 Feb. 7, 2013

(30) Foreign Application Priority Data

Apr. 16, 2010 (GB) ..... 1006362.6

(51) Int. Cl.

| | |
|---|---|
| ***B63B 21/38*** | (2006.01) |
| ***B63B 21/42*** | (2006.01) |
| ***B63B 21/46*** | (2006.01) |
| *B63B 21/26* | (2006.01) |

(52) U.S. Cl.

CPC ..... *B63B 21/42* (2013.01); *B63B 21/38* (2013.01); *B63B 21/46* (2013.01); *B63B 2021/262* (2013.01)

(58) Field of Classification Search

CPC ..... B63B 21/243; B63B 21/26; B63B 21/30; B63B 21/32; B63B 21/34; B63B 21/38; B63B 21/40; B63B 21/42; B63B 21/44; B63B 21/46

USPC ..... 114/4, 295, 297, 299, 301, 307, 309, 114/310, 304

See application file for complete search history.

(56) References Cited

U.S. PATENT DOCUMENTS

| | | | | |
|---|---|---|---|---|
| 5,474,015 | A * | 12/1995 | Bruce | 114/294 |
| 5,546,883 | A | 8/1996 | Van Den Haak | |
| 6,220,198 | B1 | 4/2001 | Bruce | |
| 6,598,555 | B1 * | 7/2003 | Bruce | 114/294 |

FOREIGN PATENT DOCUMENTS

| | | | |
|---|---|---|---|
| WO | 93/11028 | A1 | 6/1993 |
| WO | 98/32648 | A1 | 7/1998 |
| WO | 2011/128689 | A2 | 10/2011 |

* cited by examiner

*Primary Examiner* — Daniel V Venne

(74) *Attorney, Agent, or Firm* — Benjamin A. Balser; Balser & Grell IP Law

(57) ABSTRACT

A marine anchor (1, 40, 40A, 40B, 40C) for deep embedment in a seabed soil (2) including a fluke member (4, 41) and a shank member (7, 49) and means (12, 62, 62A) for constraining a load application point thereon (13, 15, 63, 63A, 65) to lie in first and second directions from a centroid (9,46) of said fluke member (4, 41) forming, with respect to a fore-and-aft direction (10, 47) of the fluke member (4, 41), an acute forward-opening angle (A) and an acute rearward-opening angle (C) respectively whereby said marine anchor (1, 40, 40A, 40B, 40C) can be pulled rearward to bury deeply in a rearward direction (R) after having been pulled forward to bury deeply in a forward direction (F).

29 Claims, 7 Drawing Sheets

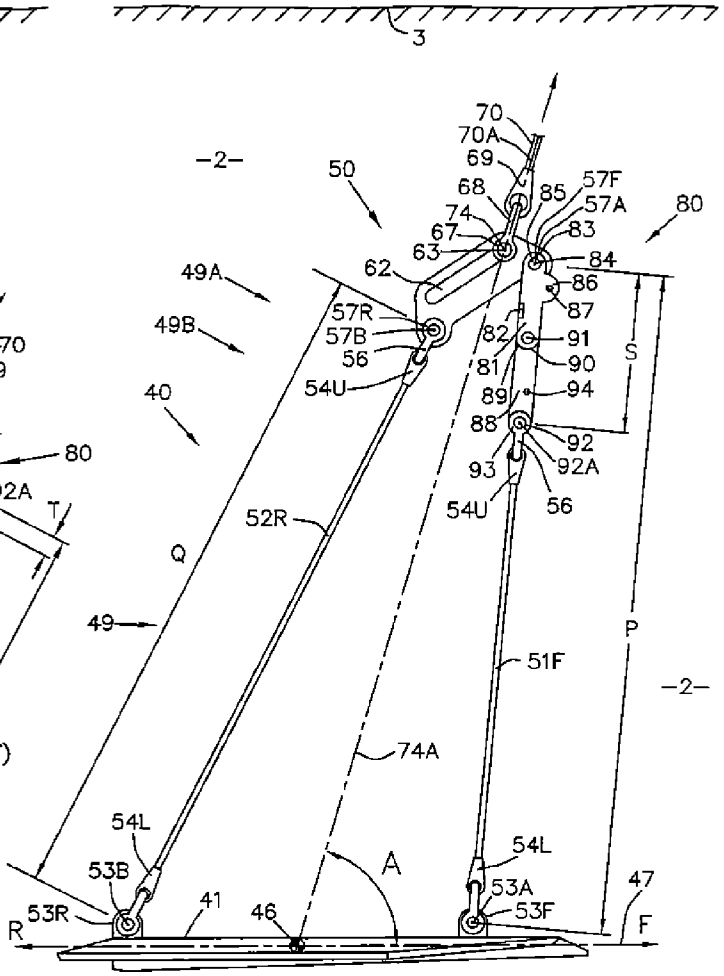
FIG. 12.
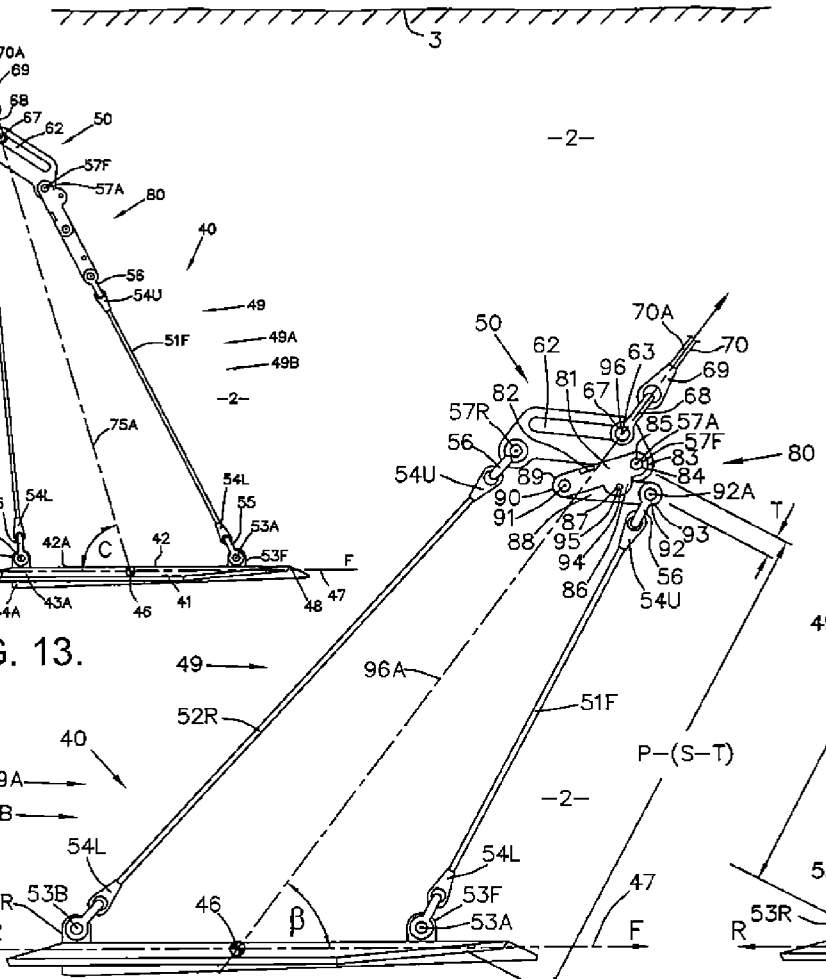
FIG. 11.
FIG. 13.

OFFSHORE MARINE ANCHOR

CROSS REFERENCE TO RELATED APPLICATIONS

This application claims priority to PCT application Ser. No. PCT/GB2011/50736 filed on Apr. 13, 2011; and to GB patent application Ser. No. 1006362.6, filed on Apr. 16, 2010, which are incorporated by reference herein.

The present invention relates to marine anchors and particularly to drag embedment and direct embedment marine anchors for use in hurricanes by the offshore industry. Drag embedment marine anchors are initially pulled horizontally to effect penetration through a seabed surface. Direct embedment marine anchors are pushed through the seabed surface by a heavy elongated tool, generally known as a follower, or forced through by impact due to momentum developed by falling freely from a distance above the seabed surface.

An offshore drilling or production platform is usually held in position by a number of anchor lines and anchors which, typically, are equally spaced along the circumference of a circle centred on the platform. A hurricane may exert large forces on such a platform. These forces may be large enough to part the anchor lines at the weather side of the platform if the anchors have been selected to provide holding capacity in excess of the breaking load of the anchor lines. If one or more of the anchor lines part on the weather side of the platform, adjacent anchor lines will become overloaded and, in turn, may part. The platform may then be driven off station whereupon the lee side anchors will be subjected to a change in the azimuthal direction of loading as tension increases in the anchor lines. These anchors will turn in the sea bed soil into the pulling direction in azimuth under increasing load and embed deeper until the remaining anchor lines part to allow the platform to drift. However, if the platform is driven along a path which passes directly over a leeside anchor, the last intact anchor line may rotate the anchor rearwards in a vertical plane to an inverted attitude whereupon increasing load will cause the anchor to lose embedment depth, break out, and drag on the sea bed surface. The dragging anchor then presents a serious hazard for any nearby pipelines as the platform drifts in the storm. Such a hazard became a costly reality during Hurricane Katrina in August, 2005, when a semi-submersible drilling platform parted anchor lines and dragged an anchor onto a nearby pipeline.

A first object of the present invention is to avoid the above-mentioned hazard by providing an improved marine anchor which, when already deeply buried below the sea bed surface and loaded in one azimuthal direction, has the capability of rotating and burying deeper to provide progressively increasing capacity when the anchor line is hauled rearwards to load it in the opposite azimuthal direction. Hereinafter, an anchor is considered to be deeply embedded in a soil below a seabed surface when the centre of area of the bearing surfaces of the flukes of the anchor, which bearing surfaces bear on the soil when the anchor is subjected to loading therein, is embedded below the seabed surface in excess of twice the square root of the area of the bearing surfaces.

A second object of the present invention is to provide an improved marine anchor having at least two operational fluke centroid angles, measured at the centroid of the anchor fluke as described herein, with each fluke centroid angle enabling the anchor to bury along a trajectory in a seabed soil.

According to a first embodiment of the present invention, a marine anchor, for embedment in a soil below a seabed surface, comprises a fluke member having substantially planar upper surfaces which bear on said soil when said anchor is subjected to loading therein, said planar upper surfaces having a centroid located in a plane of symmetry of said anchor, a shank member, at least two load application points for attachment of a connecting member for connecting said anchor to an anchor line, and a passageway for enabling said connecting member to be transferred between said load application points, such that said load application points lie on a substantially straight line which contains the centroid of said planar upper surfaces and forms an angle of inclination with a reference straight line of said anchor, located in said plane of symmetry and parallel to said planar upper surfaces, said reference straight line containing said centroid and defining a forward and a rearward direction of said anchor, and such that said passageway is fixed angularly with respect to said reference straight line, wherein said angle of inclination is a forward-opening acute angle with respect to a first load application point and a rearward-opening acute angle with respect to a second load application point whereby loading applied by said anchor line via said connecting member to said anchor at a load application point causes said anchor to bury deeper below said seabed surface in a forward direction with respect to said first load application point and in a rearward direction with respect to said second load application point.

Preferably, said forward-opening acute angle has a value in the range of 68° to 82°, with 75° further preferred, and said rearward-opening acute angle has a value in the range of 68° to 82°, with 75° further preferred.

Preferably, said passageway is adapted to receive said connecting member such that said connecting member may be transferred from a first load application point to a second load application point and vice versa by moving in said passageway.

Preferably, said passageway comprises a slot containing said first load application point and said second load application point each of which is located adjacent to an end of said slot.

Preferably, said first and second load application points are each separated from said centroid by a distance in the range of 0.12 to 0.4 times the square root of the plan area of said bearing surfaces.

Preferably, said shank member comprises a planar member.

Preferably, said first load application point is separated from said second load application point by a distance in the range of 0.03 to 0.3 times the square root of the plan area of said bearing surfaces.

Preferably, said shank member is attached rigidly to said fluke member.

Preferably, said shank member is attached to said fluke member such as to be rotatable about an axis parallel to said reference straight line.

Preferably, a straight line containing said first load application point and said second load application point is inclined to said reference straight line to form an angle in one of a forward-opening range of 0° to 15° and a rearward-opening range of 0° to 5°.

Preferably, said connecting member comprises an elongate auxiliary shank member including a clevis at a lower end for attachment by means of a load pin to said shank member and a preliminary first load application point at an upper end for attaching an anchor line.

Preferably, a shearable pin is provided between said shank member and said auxiliary shank member to hold temporarily said preliminary load application point on a straight line, containing said centroid, which is inclined to said reference straight line to form a forward-opening angle in the range of 52.degree. to 68.degree., with 60.degree. further preferred.

Preferably a deflector plate is provided at the rear of said fluke member which includes a rearward-facing surface, located at each side of said plane of symmetry of said anchor, and located in a plane intersecting said plane of symmetry in a line forming an angle of inclination relative to said reference straight line whereby said rearward-facing surface produces a deflection force from soil interaction thereon to facilitate rotation of said anchor in said soil when a rearward-directed component of force is applied to said second load application point.

Preferably said angle of inclination is in the range 10° to 40°, with 30° further preferred.

Preferably the ratio of the area of said rearward-facing surfaces to the total area of said bearing surfaces is in the range of 0.02 to 0.2, with 0.09 further preferred.

According to a second embodiment of the present invention, a marine anchor, for embedment in a soil below a seabed surface, comprises a fluke member including plates having substantially planar upper surfaces which bear on said soil when said anchor is subjected to loading therein, said planar upper surfaces having a centroid located in a plane of symmetry of said anchor, a shank member including at least two pivotable elongate members and a coupling member serving to couple said elongate members distal from said fluke member, and a load application point for attachment of a connecting member for connecting said anchor to an anchor line, such that said load application point lies on a substantially straight line which contains the centroid of said planar upper surfaces and forms a centroid angle of inclination with a reference straight line of said anchor located in said plane of symmetry and parallel to said planar upper surfaces, said reference straight line containing said centroid and defining a forward and a rearward direction of said anchor, said elongate members being of length such as to maintain said coupling member clear of said fluke member when said anchor is subjected to loading by said anchor line, said elongate members being attached to said fluke member at attachment points such that projections of said attachment points on said plane of symmetry are spaced apart, said elongate members being attached to said coupling member at attachment points spaced apart on said coupling member, wherein said coupling member includes at least two load application points and a passageway configured for enabling said connecting member, when attached to said coupling member, to be transferred between said load application points by moving said passageway such that said anchor comprises a multi-stable mechanism, operable by said anchor line, whereby said connecting member may be moved reversibly between at least two stable positions of location of a load application point.

Preferably, said elongate members comprise at least one of wires, lines, stays, cables, chains and rigid beams.

Preferably, two forward pairs of said elongate members and two rearward pairs of said elongate members are provided and are of lengths such that said stable positions are located at a distance from the centroid of bearing surfaces of said fluke member, which bearing surfaces bear on said soil when said anchor is subject to loading therein, said distance being in the range of 0.5 to 1.65 times the square root of the plan area of said bearing surfaces, with the range of 0.8 to 1.2 times further preferred.

Preferably, said centroid angle of inclination relating to each of two adjacent stable positions is selected to be in a different one of five ranges: three forward-opening ranges comprising 36° to 52°, with 47° further preferred, 52° to 68°, with 60° further preferred, and 68° to 82°, with 75° further preferred; one intermediate range of 85° to 95°, with 90° further preferred; and one rearward-opening range of 68° to 82°, with 75° further preferred.

Preferably, said passageway comprises a slot.

Preferably, said coupling member comprises a planar member including said slot, two spaced attachment points for attaching said elongate members, and said first load application point and said second load application point each located in and adjacent to an end of said slot.

Preferably, said first and second load application points are separated by a distance L which is less than a distance M separating said two spaced attachment points.

Preferably the ratio of said distance M to said distance L is in the range of 1 to 3, with the range of 1.5 to 2.5 further preferred.

Preferably a first straight line containing said first and second load application points is parallel to a second straight line containing said two spaced attachment points, said first and second straight lines being separated by a distance in the range of zero to 0.5 times said distance M.

Preferably, said multi-stable mechanism comprises a bi-stable mechanism wherein said coupling member includes a straight slot containing first and second load application points locatable at corresponding first and second stable positions, said first and said second stable positions defining respectively a forward-opening acute centroid angle and a rearward-opening acute centroid angle each in the range of 68° to 82°, with 75° further preferred.

Preferably, said multi-stable mechanism comprises a bi-stable mechanism wherein said coupling member includes a straight slot containing first and second load application points locatable at corresponding first and second stable positions, said first and said second stable positions defining respectively a first forward-opening acute centroid angle in the range of 52° to 68°, with 60° further preferred, and a second forward-opening acute angle in the range of 68° to 82°, with 75° further preferred.

Preferably, said slot in said coupling member has a bend therein serving to provide an intermediate load application point between said first and second load application points with axes of said slot at each side of said bend forming an included downward-opening obtuse angle in the range of 140° to 160°, with 150° further preferred.

Preferably, said multi-stable mechanism comprises a tri-stable mechanism wherein said coupling member includes a bent slot containing first and second load application points locatable at corresponding first and second stable positions, said first and said second stable positions defining respectively a forward-opening acute centroid angle and a rearward-opening acute centroid angle each in the range of 68° to 82°, with 75° preferred, and containing an intermediate load application point locatable at an intermediate stable position defining one of a forward-opening acute centroid angle and a rearward-opening acute centroid angle each in the range of 85° to 90°, with 90° further preferred.

Preferably, said multi-stable mechanism comprises a tri-stable mechanism wherein said coupling member includes a bent slot containing first and second load application points locatable at corresponding first and second stable positions, said first stable position defining a first forward-opening acute centroid angle in the range of 36° to 52° with 46° preferred, said second stable position defining a second forward-opening acute centroid angle in the range of 68° to 82°, with 75° preferred, and containing an intermediate load application point locatable at an intermediate stable position defining an intermediate forward-opening centroid angle in the range of 52° to 68°, with 60° further preferred.

Preferably, said multi-stable mechanism comprises a tri-stable mechanism wherein said coupling member includes bent slot containing first and second load application points locatable at corresponding first and second stable positions, said first stable position defining a forward-opening acute centroid angle in the range of 52° to 68°, with 60° preferred, said second stable position defining a rearward-opening acute centroid angle in the range of 68° to 82°, with 75° further preferred, and containing an intermediate load application point locatable at an intermediate stable position defining an intermediate forward-opening centroid angle in the range of 68° to 82°, with 75° further preferred.

Preferably, a distance adjuster is provided in said shank member for altering temporarily the distance between an attachment point on said coupling member for at least one of said elongate members and a corresponding attachment point on said fluke member to provide a preliminary stable position for said first load application point whereby a straight line containing said first load application point and said centroid forms with said reference straight line a preliminary forward-opening acute angle in one of the range of 36.degree. to 52.degree., with 46.degree. further preferred, and the range of 52.degree. to 68.degree., with 60.degree. further preferred, when said anchor line is tensioned.

Preferably, said distance adjuster comprises two elongate elements connected by a hinge joint, with an attachment point on each element distal from said hinge joint for attachment between said forward attachment point on said coupling member and said fluke member, whereby said elements provide minimum or maximum separation of attachment points when closed or opened respectively.

Preferably, a shareable pin is provided between said elements to hold said elements temporarily together with said attachment points at minimum separation.

Preferably, a deflector plate is provided at the rear of said fluke member which include a rearward-facing upper surface, located at each side of said plane of symmetry of said anchor, and located in a plane intersecting said plane of symmetry in a line forming an angle of inclination relative to said reference straight line whereby said rearward-facing upper surfaces produce a deflection force from soil interaction thereon to facilitate rotation of said anchor in said soil when a rearward-directed component of force is applied to said second load application point.

Preferably, said angle of inclination is in the range of 10° to 40°, with 30° further preferred.

Preferably, the ratio of the area of said rearward-facing upper surfaces to the total area of said planar upper surfaces is in the range of 0.02 to 0.2, with 0.09 further preferred.

Embodiments of the present invention will now be described by way of example with reference to the accompanying drawings wherein:

FIG. 11 shows a side view of the anchor of FIG. 5 including a distance adjuster in a closed configuration and a preliminary forward-opening acute angle β;

FIG. 12 shows a side view of the anchor of FIG. 5 including a distance adjuster in an opened configuration and a forward-opening first acute angle A;

FIG. 13 shows a side view of the anchor of FIG. 5 including a distance adjuster in an opened configuration and a rearward-opening second acute angle C;

Figure 1:
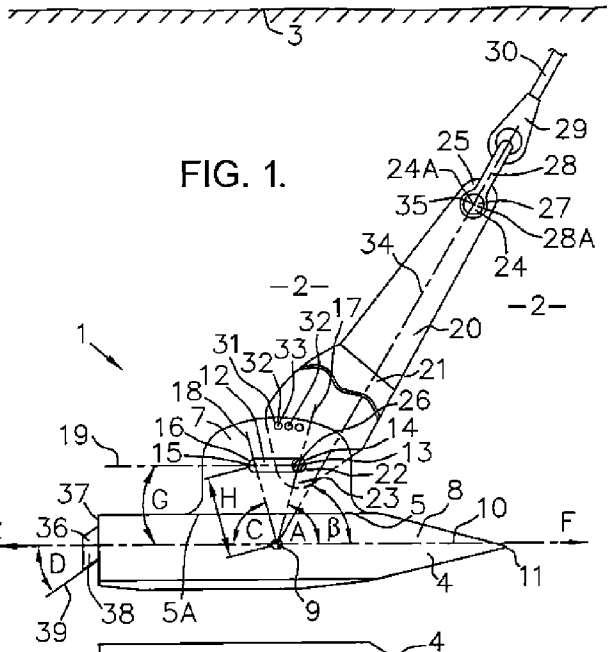
FIG. 1 shows a side view of a marine anchor according to a first embodiment of the present invention.
Figure 3:
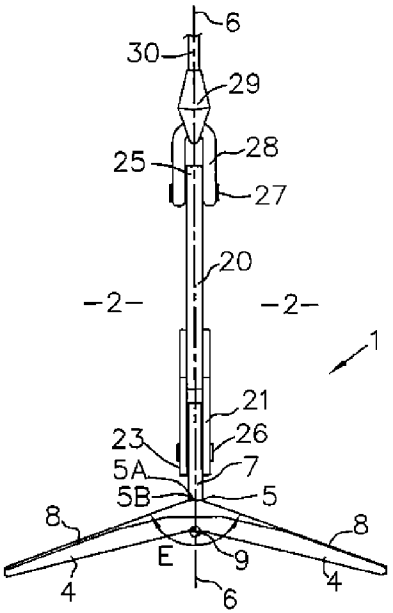
FIG. 3 shows a front view of the anchor of FIG. 1.
Figure 2:
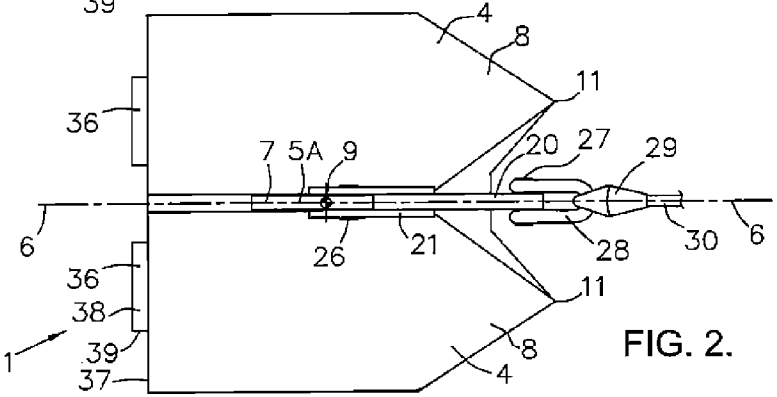
FIG. 2 shows a plan view of the anchor of FIG. 1.
Figure 4:
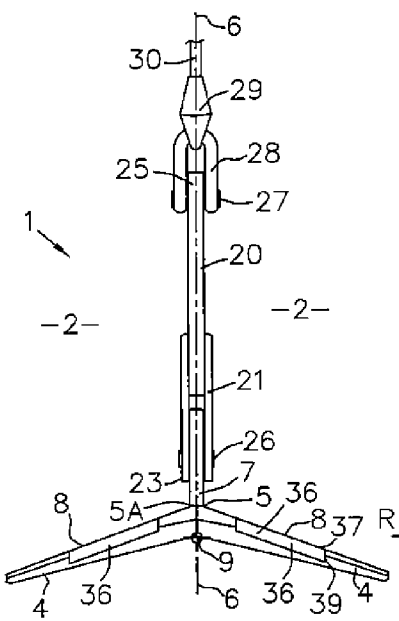
FIG. 4 shows a rear view of the anchor of FIG. 1.

Referring to FIGS. 1 to 4, in a first embodiment of the present invention, a marine anchor 1 for deep embedment in operation in a soil 2 below a seabed surface 3 comprises two flukes 4 joined together at a junction 5 in a plane of symmetry 6 of anchor 1 and together attached rigidly along junction 5 to a plate shank 7 located in plane of symmetry 6. Plane of symmetry 6 is shown as a vertical dashed line in FIGS. 3 and 4 and a horizontal dashed line in FIG. 2. Each fluke 4 has a planar upper surface 8. Upper surfaces 8 are inclined relative to each other to include an anhedral angle E (FIG. 3) having a magnitude in the range 120° to 180° with 140° preferred. The centroid 9 (FIG. 1) of combined surfaces 8 lies in plane of symmetry 6. A reference straight line 10 containing centroid 9 and lying parallel to planar upper surfaces 8 defines a forward direction F and a rearward direction R of anchor 1. Each fluke 4 has a generally pentagonal shape in plan view (FIG. 2) with a forward point 11 spaced from plane of symmetry 6. Plate shank 7 includes an elongated slot 12 having a first load application point 13 at a forward end 14 and a second load application point 15 at a rearward end 16 of slot 12. The distance separating each of first load application point 13 and second load application point 15 from centroid 9 is in the range $0.12\sqrt{A}$ to $0.4\sqrt{A}$ with the range $0.15\sqrt{A}$ to $0.25\sqrt{A}$ preferred where A denotes the combined plan area of flukes 4 as shown in FIG. 2. The distance separating first load application point 13 from second load application point 15 is in the range of $0.03\sqrt{A}$ to $0.3\sqrt{A}$. A straight line 17 containing centroid 9 and first load application point 13 forms a forward-opening acute centroid angle A with reference straight line 10. Similarly, a straight line 18 containing centroid 9 and second load application point 15 forms a rearward-opening acute centroid angle C with reference straight line 10. The magnitude of each of centroid angle A and centroid angle C is in the range 68° to 82°, with 75° further preferred. It is preferred but not essential that centroid angle C is equal to centroid angle A. Axis 19 of slot 12 contains first load application point 13 and second load application point 15 and lies at a forward-opening angle G relative to reference straight line 10. The magnitude of forward-opening angle G is chosen to be in the range 5° negative to 15° positive with 0° preferred, where first load application point 13 is nearer to reference straight line 10 than second load application point 15 when angle G is negative.

Anchor 1 includes an elongate auxiliary shank 20 which has a clevis 21 including a pin hole 22 at a lower end 23 and a shackle lug hole 24 at an upper end 25. The distance between pin hole 22 and shackle lug hole 24 is in the range 0.7 √A to √A, with 0.85 √A preferred. Clevis 21 straddles shank 7 and is attached thereto by a load pin 26 located in pin hole 22 and passing through slot 12. The diameter of load pin 26 is slightly smaller than the width of slot 12 so that load pin 26 can slide freely from first load application point 13 to second load application point 15 when a component of load in direction F in anchor line 30 is reversed to cause auxiliary shank 20 to rotate anticlockwise about load pin 26 (FIG. 1) and move rearwards in direction R. For clarity, FIG. 1 shows clevis 21 partially sectioned to show the first load application point 13 in shank 7 at the forward end 14 of slot 12.

Pin 27 of shackle 28 is fitted in shackle lug hole 24, which has a centre 24A, to connect auxiliary shank 20 via shackle 28 and socket 29 to anchor line 30. Clevis 21 includes a shear pin hole 31 positioned to be alignable with one of a plurality of shear pin holes 32 in shank 7 for receiving shear pin 33. When shear pin 33 is located in shear pin hole 31 and in one of shear pin holes 32, load pin 26 is located at first load application point 13 and auxiliary shank 20 is held such that a straight line 34 containing the centre 24A and centroid 9 forms a preliminary forward-opening acute centroid angle β relative to reference straight line 10. The magnitude of preliminary forward-opening centroid angle β is chosen to be in the range 52° to 68° with 60° preferred for operation in soft clay soils. The plurality of shear pin holes in shank 7 permits step-wise selection of the magnitude of angle β by locating shear pin 33 in a particular shear pin hole in shank 7. When auxiliary shank 20 is thus constrained by shear pin 33, centre 24A of shackle lug hole 24 is held at a preliminary load application point 35, defining preliminary forward-opening centroid angle β relative to flukes 4 of anchor 1, which facilitates complete penetration of anchor 1 through seabed surface 3 and along an inclined sub-surface trajectory constrained by centroid angle β to reach a depth of penetration of centroid 9 below seabed surface 3 of about 2 √A. This is sufficiently deep to allow shear pin 33 to be parted safely, by increasing the inclination of anchor line 30 while under tension, to free auxiliary shank 20 to rotate about load pin 26 and so transfer the loading applied to anchor 1 from preliminary load application point 35 to first load application point 14 to enable subsequent burying along a more steeply inclined trajectory constrained by larger forward-opening acute centroid angle A.

A deflector plate 36 (FIGS. 1, 2, and 4) is located at a rear edge 37 of fluke 4 and has a planar upper surface 38 which forms an inclined extension of fluke surface 8. A straight line 39 parallel to plane of symmetry 6 and lying in surface 38 forms a rearward-opening angle D with reference line 10 when projected onto plane of symmetry 6. The magnitude of angle D is in the range 10° to 40° with 30° preferred. The ratio of the total area of deflector plate upper surfaces 38 to the total area of fluke surfaces 8 is in the range 0.02 to 0.2 with 0.09 preferred.

In a modification of anchor 1 (FIGS. 1 to 4), flukes 4 are hingedly instead of rigidly attached to shank 7 by hinge 5A (not shown). Hinge 5A is located between junction 5 and shank 7 with the axis 5B of hinge 5A lying in plane of symmetry 6 and parallel to reference straight line 10 to permit shank 7 to be rotated out of plane of symmetry 6 to permit anchor 1 to resist loading out of the plane of symmetry 6 as the azimuthal direction of anchor line 30 changes.

Referring to FIGS. 5 to 10, in a second embodiment of the present invention, a marine anchor 40 for deep embedment in operation in a soil 2 below a seabed surface 3 comprises a fluke 41 formed by a central plate 42 with an upper surface 42A and two inclined side plates 43 each with an upper surface 43A and each joined to central plate 42 at junctions 44. Junctions 44 are parallel to and spaced from a plane of symmetry 45 (FIGS. 7, 8, and 9) of anchor 40. Plate stiffening ribs 44A (FIGS. 5 to 9) are attached to an underside of fluke 41 along the length of each of junctions 44. Side plates 43 are inclined relative to each other to include an anhedral angle E below fluke 41 (FIGS. 7 and 8) of magnitude in the range 180° to 120° with 140° preferred. Centroid 46 (FIG. 9) of the combined upper surfaces 42A and 43A of plates 42 and 43 lies in the plane of symmetry 45. Reference straight line 47 (FIGS. 5, 6, and 9) containing centroid 46 and lying parallel to upper surface 42A of central plate 42 defines forward direction F and rearward direction R of anchor 40. At each side of plane of symmetry 45, each half of fluke 41 has a generally pentagonal shape in plan view with a forward point 48 spaced from plane of symmetry 45. A deflector plate 76 (FIGS. 5, 6, and 9) is located at a rear edge 77 of central plate 42 of fluke 41 and has a planar upper surface 78 (FIG. 9) which forms an inclined extension of upper surface 42A of central plate 42. A straight line 79 (FIG. 5) parallel to plane of symmetry 45 and located in surface 78 forms a rearward-opening angle D with reference line 47 measured in plane of symmetry 45. The magnitude of angle D is in the range 10° to 40° with 30° preferred. The ratio of the area of deflector plate upper surface 78 to the total plan area of surfaces 42A and 43A is in the range 0.02 to 0.2 with 0.09 preferred.

Figure 6:
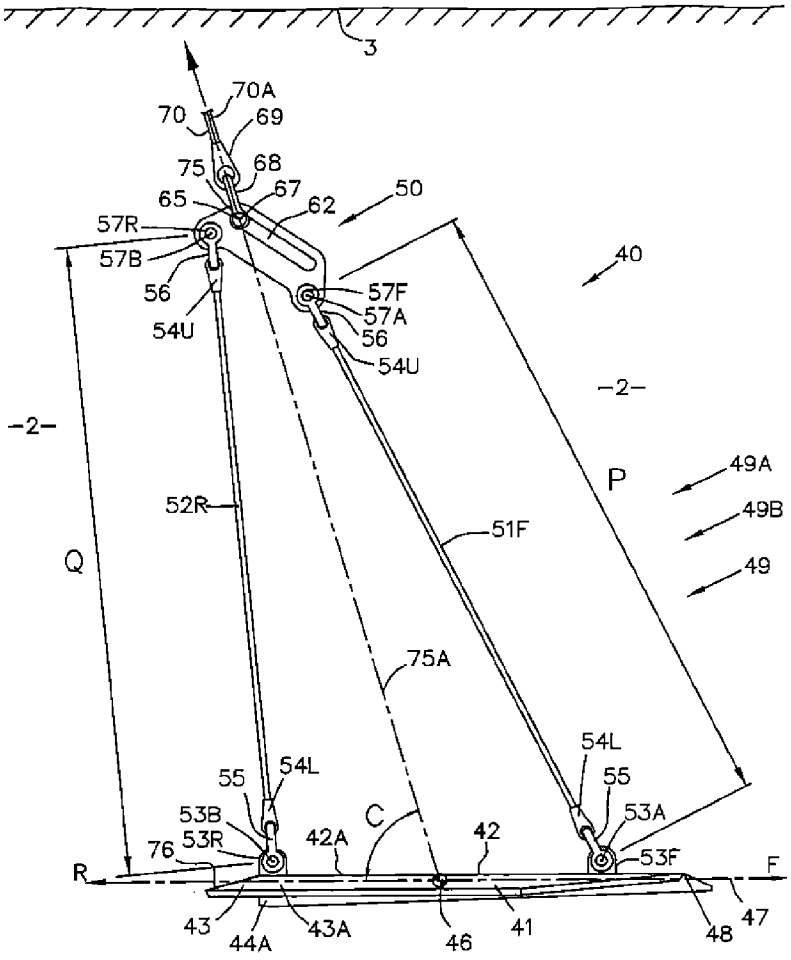
FIG. 6 shows a side view of a marine anchor in a second stable configuration according to a second embodiment of the present invention.
Figure 5:
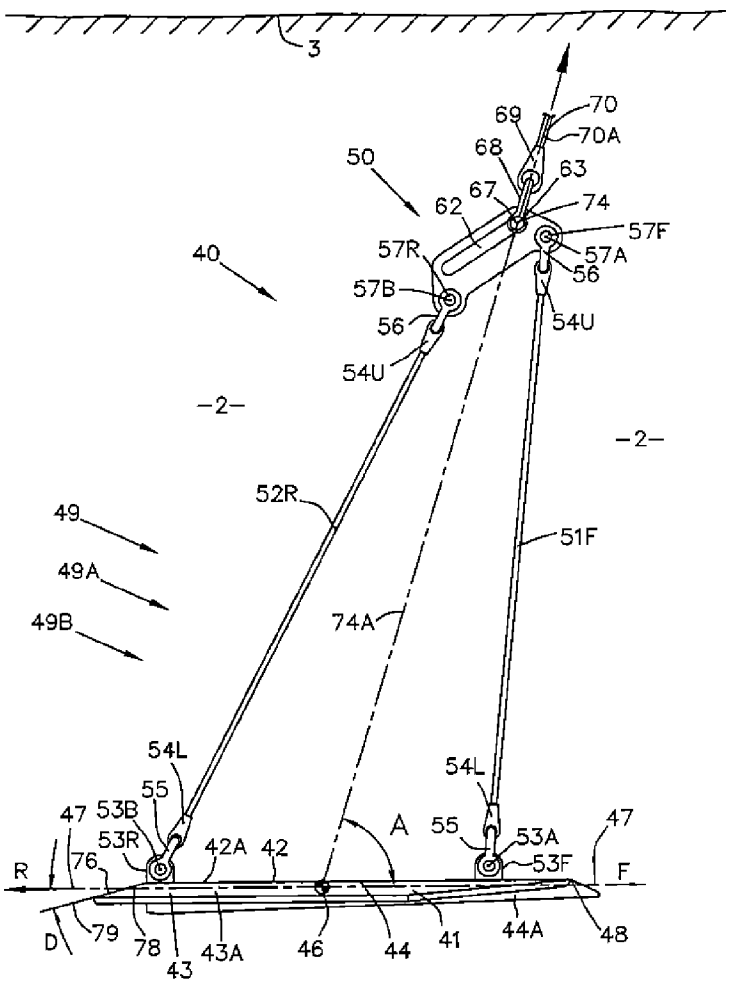
FIG. 5 shows a side view of a marine anchor in a first stable configuration according to a second embodiment of the present invention.
Figure 8:
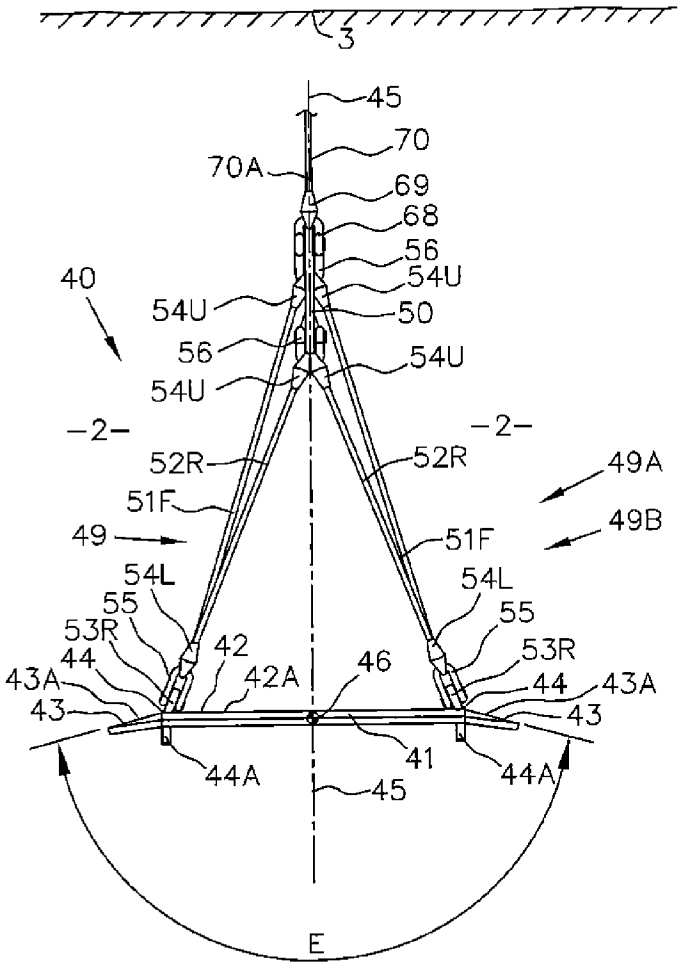
FIG. 8 shows a front view of the anchor of FIG. 6.
Figure 7:
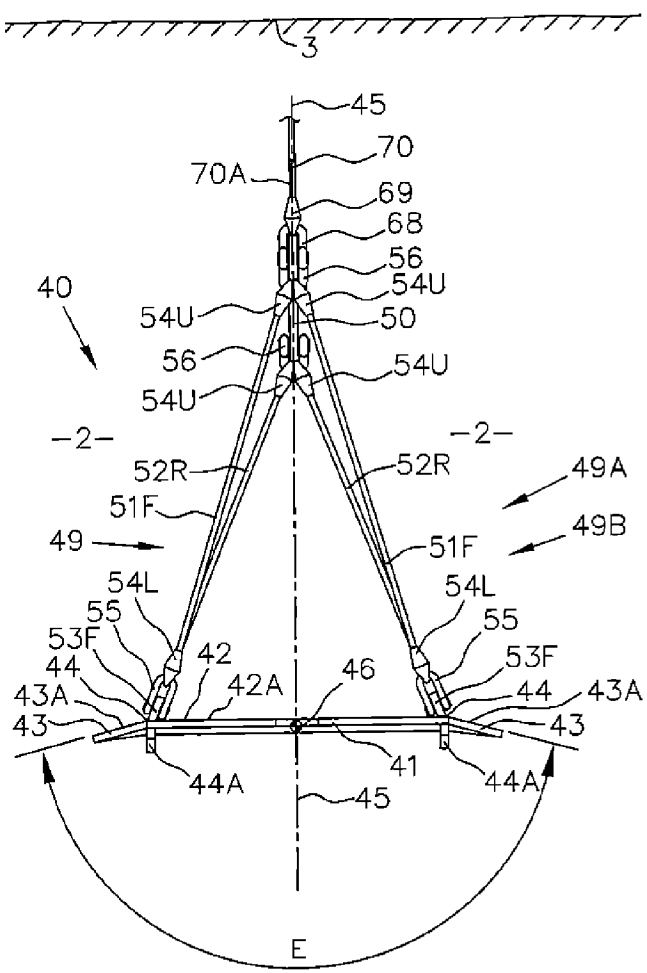
FIG. 7 shows a front view of the anchor of FIG. 5.
Figure 9:
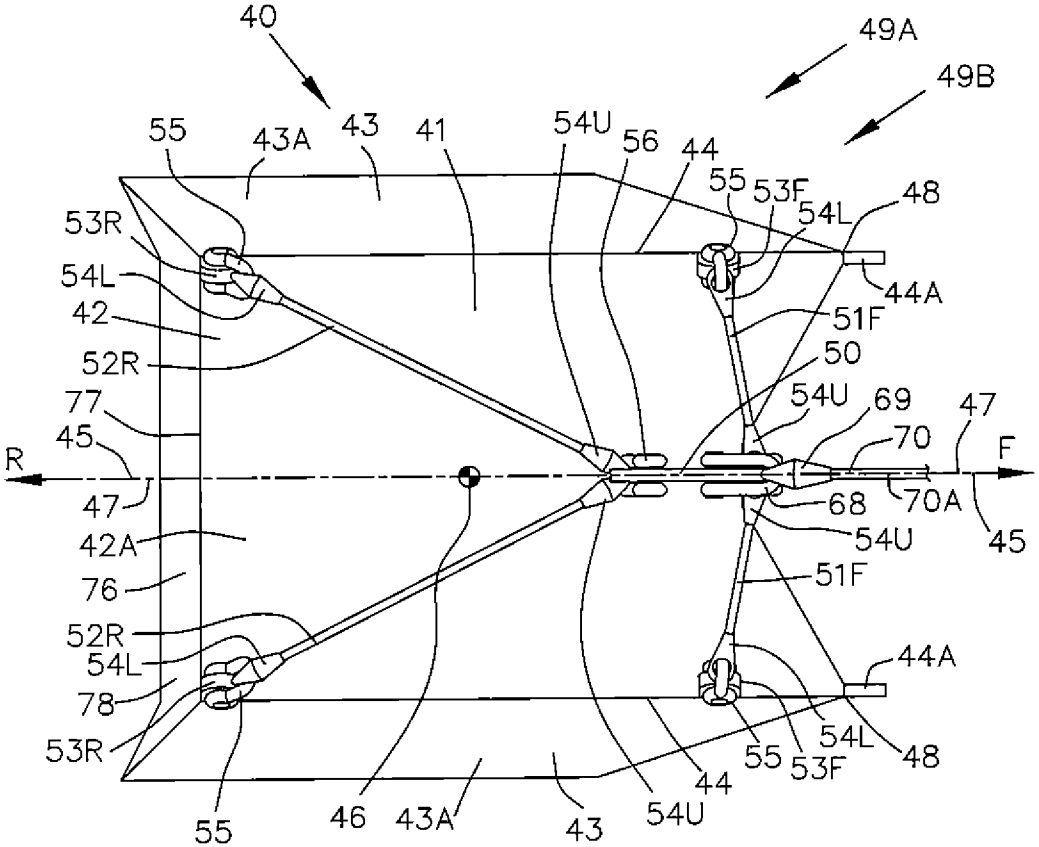
FIG. 9 shows a plan view of the anchor of FIG. 5.

Shank 49 of anchor 40 includes a coupling plate 50 (FIGS. 5 and 6) and two forward cables 51F and two rearward cables 52R. Shank 49 is attached to a forward lug 53F and to a rearward lug 53R on each of stiffening ribs 44A of fluke 41. Lugs 53F and 53R have centres 53A and 53B respectively and protrude through upper surfaces 42A and 43A of fluke 41. Lugs 53F and 53R are equally spaced from centroid 46 (FIG. 9). Each of cables 51F and 52R is terminated by a socket 54L at each lower end and by a socket 54U at each upper end. Each of sockets 54L has a shackle 55 linked there-through as a means of attaching each forward cable 51F to each corresponding forward lug 53F and each rearward cable 52R to each corresponding rearward lug 53R. Forward pair of cables 51F is attached to coupling plate 50 at a forward lug hole 57F with centre 57A by a shackle 56 linking through two sockets 54U (FIGS. 5, 6, and 7). Similarly, rearward pair of cables 52R is attached to coupling plate 50 at a rearward lug hole 57R with centre 57B by a shackle 56 linking through two sockets 54U (FIGS. 5, 6, and 8).

Figure 10:
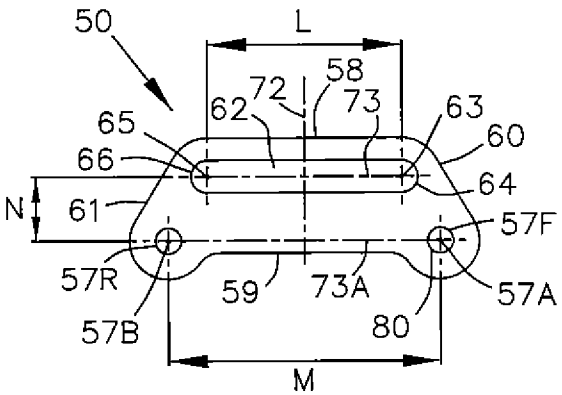
FIG. 10 shows, to a larger scale, a coupling plate having two load application points as shown in FIG. 5.

Referring now to FIG. 10, for inclusion in anchor 40, a coupling plate 50 is generally of quadrilateral shape in side view with upper edge 58 lying parallel to lower edge 59 separated by forward edge 60 and rearward edge 61. An elongated slot 62 is located above forward lug hole 57F and rearward lug hole 57R in coupling plate 50 and has therein a first load application point 63 at forward end 64 of slot 62 and a second load application point 65 at rearward end 66 of slot 62. Slot 62 serves to receive pin 67 of shackle 68 (FIG. 5) which is provided for linking through terminal socket 69 of anchor line 70. Slot 62 is slightly greater in width than the diameter of pin 67 of shackle 68 whereby pin 67 may slide from first load application point 63 at forward end 64 of slot 62 to second load application point 65 at rearward end 66 of slot 62. Distance L (FIG. 10) between first load application point 63 and second load application point 65 of coupling plate 50 is preferred to be less than distance M separating centres 57A and 57B of lug holes 57F and 57R respectively in coupling plate 50. Distance L plus the diameter of pin 67 equals the overall length of slot 62. Ratio M/L is preferably in the range of 1 to 3 with the range 1.5 to 2.5 further preferred. Lug holes 57F and 57R are preferably but not necessarily symmetrically disposed about a straight line 72 in the plane of coupling plate 50 which bisects at right angles a straight line 73 containing first load application point 63 and second load application point 65. A straight line 73A contains centres 57A and 57B of lug holes 57F and 57R respectively and lies parallel to straight line 73. Distance N between straight line 73 and straight line 73A is preferably in the range of zero to 0.5 times distance M with the range zero to 0.3 times distance M further preferred, although values of N outside of this range may be used. Coupling 50 enables a bi-stable mechanism 49B to be realized in anchor 40 as hereinafter described.

In anchor 40, when pin 67 of shackle 68 is lodged at first load application point 63 and cables 51F and 52R are taut, first load application point 63 is held at first stable point 74 and a straight line 74A containing first stable point 74 and centroid 46 forms a forward-opening acute angle A with reference straight line 47 (FIG. 5). Likewise, when pin 67 is lodged at second load application point 65 and cables 51F and 52R are taut, first load application point 65 is held at second stable point 75 and a straight line 75A containing second stable point 75 and centroid 46 forms a rearward-opening acute angle C with reference straight line 47 (FIG. 6). The magnitudes of distances L, M, and N of coupling plate 50 (FIG. 10) may be chosen together with distances P and Q of shank 49 (FIG. 6) to obtain any practical desired value for angle A or angle C. Distance P is the distance, measured in plane of symmetry 45 (FIGS. 7, 8 and 9), between centre 57A of forward lug hole 57F in coupling plate 50 and the intersection with plane of symmetry 45 of a straight line joining centres 53A of forward lugs 53F on fluke 41. Distance Q is the distance, measured in plane of symmetry 45, between centre 57B of rearward lug hole 57R in coupling plate 50 and the intersection with plane of symmetry 45 of a straight line joining centres 53B of rearward lugs 53R on fluke 41. Distances P and Q are such that coupling plate 50 is maintained clear of fluke 41 when anchor 40 is subjected to loading by anchor line 70.

When a forward-directed component of force is applied to anchor 40 when buried in soil 2, by tensioning anchor line 70, pin 67 of shackle 68 lodges at first load application point 63 and so tensions cables 51F and cables 52R. In consequence, shank 49 including cables 51F, cables 52R, and coupling plate 50 rotate to bring first load application point 63 into first stable position 74 relative to fluke 41 when force equilibrium is established. Straight line 74A (FIG. 5), containing first stable position 74 and centroid 46, is now collinear with axis 70A of anchor line 70 and forms forward-opening angle A with reference straight line 47, in the range 68° to 82° with 75° preferred. The separation between first stable position 74 and centroid 46 is chosen to be in the range 0.5 √A to 1.7 √A with the range 0.8 √A to 1.2 √A preferred. Pin 67 is stable when held at first stable position 74, while lodged at first load application point 63, in that the inclination to the horizontal of axis 70A of anchor line 70 at shackle 68 can be changed progressively from being almost parallel to a plane containing cables 51F to being almost parallel to a plane containing cables 52R without dislodging pin 67 of shackle 68 from first load application point 63 or completely losing tension in either of cables 51F or cables 52R. Thus, the inclination of axis 70A of anchor line 70 can be varied, for example, by about plus or minus 15° without causing pin 67 of shackle 68 to slide in slot 62 of coupling plate 50 away from first load application point 63.

When anchor line 70 is now pulled such as to introduce a rearward component of force on anchor 40 via pin 67 of shackle 68, lodged at first load application point 63 and presently held at first stable position 74 (FIG. 5), shank 49 including cables 51F and cables 52R rotate anticlockwise rearward (FIG. 6) under tension while coupling plate 50 rotates clockwise such that pin 67 of shackle 68 slides in slot 62 from first load application point 63 to second load application point 65. When force equilibrium is re-established, second load application point 65 is held in second stable position 75 (FIG. 6) relative to fluke 41 while the rearward-directed component of tension is maintained. Straight line 75A, containing second stable position 75, axis 70A (FIG. 6) of anchor line 70, and centroid 46, forms rearward-opening angle C with reference straight line 47, in the range 68° to 82° with 75° preferred. The separation between second stable position 75 and centroid 46 is chosen to be in the range 0.5 √A to 1.65 √A with the range 0.9 √A to 1.3 √A preferred where A denotes the plan area of fluke 41 as shown in FIG. 6. Pin 67 is stable when held at second stable position 75, while lodged at second load application point 65, in that the inclination to the horizontal of axis 70A of anchor line 70 at shackle 68 can be changed progressively from being almost parallel to a plane containing cables 52R to being almost parallel to a plane containing cables 51F without dislodging pin 67 from second load application point 65 or completely losing tension in either of cables 52R or cables 51F. The inclination of axis 70A of anchor line 70 can be varied, for example, by about plus or minus 15° without causing pin 67 to slide in slot 62 of coupling plate 50 away from second load application point 65.

It is notable that when cables 51F and 52R rotate anticlockwise under tension, coupling plate 50 rotates clockwise. This progressively changes the inclination to horizontal of slot 62 and so precipitates sliding therein of pin 67 of shackle 68 from first load application point 63 to second load application point 65 of coupling plate 50 and, hence, when force equilibrium is established, from first stable position 74 to second stable position 75, driven by tension in anchor line 70. The arrangement of anchor 40 comprising fluke 41 and shank 49 including cables 51F, cables 52R, and coupling plate 50, together with shackle 68, thus constitutes a bi-stable mechanism 49B wherein an appropriate and sufficient change of the inclination of axis 70A of anchor line 70 attached to shackle 68 can trigger, or switch, the bi-stable mechanism 49B from a first to a second stable geometrical configuration including forward-opening acute angle A and rearward-opening acute angle C respectively and vice versa.

Referring to FIGS. 11 to 13, marine anchor 40 is fitted with a distance adjuster 80 (FIGS. 11 and 12) for altering temporarily distance P to provide a forward-opening acute angle β which is smaller than forward-opening acute angle A. Angle β is in the range of 54° to 66°, with 60° preferred. Angle β is provided to facilitate penetration of fluke 41 through seabed surface 3 into a soft soil 2. Distance adjuster 80 is connected between forward lug hole 57F on coupling plate 50 and shackle 56 linking with sockets 54U which terminate appropriately shortened forward cables 51F. Distance adjuster 80 comprises two parallel identical elongated plates 81 fixed together and spaced sufficiently apart by a spacing plate 82 to be able to straddle coupling plate 50. At a forward end 83 of plates 81 is a hole 84 having a diameter equal to that of forward lug hole 57F in coupling plate 50. Pin 85 is located through holes 84 and 57F to attach distance adjuster 80 to coupling plate 50 instead of shackle 56. Plates 81 have lugs 86 containing shear pin hole 87 located towards hole 84 on the opposite side of plates 81 from spacing plate 82. An elongated plate 88 is located between plates 81 and is hingedly attached at a rearward end 89 of plate 88 to a rearward end 90 of plates 81 by pin 91. A hole 92 with centre 92A is provided at a forward end 93 of plate 88 for the attachment of shackle 56 linking with sockets 54U which terminate cables 51F. Plate 88 can swing between plates 81 to bring a shear pin hole 94 in plate 88 into alignment with shear pin hole 87 in plates 81 whereby a shear pin 95 may be fitted in the aligned holes. When shear pin 95 parts, plates 81 and 88 are free to rotate into axial alignment (FIG. 12) and thus increase separation distance P−(S−T) (FIG. 11) between centre 57A of lug hole 57F and centre 53A of lug 53F by distance S minus T. S is the maximum distance possible (FIG. 12) between centre 57A of hole 57F and centre 92A of hole 92 when shear pin 95 is omitted or parted. Distance T (FIG. 11) is the minimum distance separating centre 57A of hole 57F and centre 92A of hole 92, measured parallel to cable 51F, when shear pin 95 is fitted and is intact. When shear pin 95 is fitted between plates 81 and 86 of distance adjuster 80 of anchor 40, distance P is shortened by distance (S−T). When a forward-directed component of force is applied at first load application point 63, first load application point 63 is now held at a preliminary stable position 96 relative to fluke 41 (FIG. 11). A straight line 96A containing preliminary stable position 96 and centroid 46 forms acute forward-opening angle β with reference straight line 47. The magnitude of angle β is determined by selecting appropriate magnitudes for distances S and T (FIGS. 11 and 12) and, as mentioned previously, is in the range of 54° to 66° with 60° preferred for soft soils.

When anchor 40 is laid on seabed surface 3 and pulled horizontally thereon by anchor line 70 with pin 67 of shackle 68 located at first load application point 63 of coupling plate 50, penetration of fluke 41 through seabed surface 3 into soil 2 is facilitated by the presence of forward-opening acute angle β maintained by shear pin 95 in closed distance adjuster 80 (FIG. 11). When centroid 46 of fluke 41 is at a certain depth below seabed surface 3 exceeding 2 √A, soil loading on fluke 41 causes shear pin 95 to part. Consequently, distance adjuster 80 opens to allow shank 49 to rotate and so move pin 67 from preliminary stable position 96 to first stable position 74 which defines forward-opening acute angle A (FIG. 12). As before, angle A is in the range of 68° to 82° with 75° preferred. As previously mentioned, the separation between first stable position 74 and centroid 46 is chosen to be in the range 0.5 √A to 1.65 √A with the range 0.9 √A to 1.3 √A preferred. When the direction of anchor line 70 is now altered and tensioned to apply a rearward-directed component of force at first load application point 63 held at first stable position 74, cables 51F together with opened distance adjuster 80 and cables 52R rotate anticlockwise rearward under tension and coupling plate 50 rotates clockwise such that pin 67 of shackle 68 slides in slot 62, driven by tension in anchor line 70, from first load application point 63 to second load application point 65. The second load application point 65 arrives at and is held at second stable position 75 (FIG. 13) relative to fluke 41 while the rearward-directed component of force is maintained. A straight line 75A containing second stable position 75 and centroid 46, is collinear with axis 70A of anchor line 70 and forms a rearward-opening acute angle C with reference straight line 47, in the range of 68° to 82°, with 75° preferred. As previously mentioned, the separation between second stable position 75 and centroid 46 is chosen to be in the range 0.5 √A to 1.65 √A with range 0.9 √A to 1.3 √A preferred. As before, the arrangement of shank 49 (now including opened distance adjuster 80, cables 51F, cables 52R, and coupling plate 50), shackle 68, and fluke 41 constitutes a bi-stable mechanism 49B.

Figure 15:
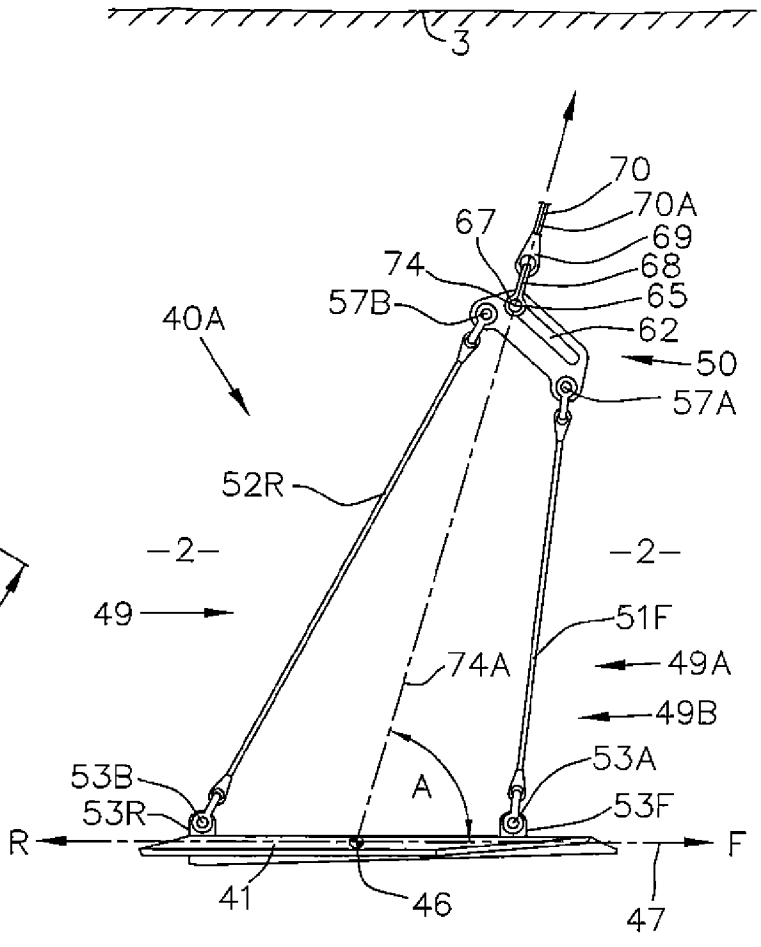
FIG. 15 shows a side view of the anchor of FIG. 5 with a forward-opening first acute angle A.
Figure 14:
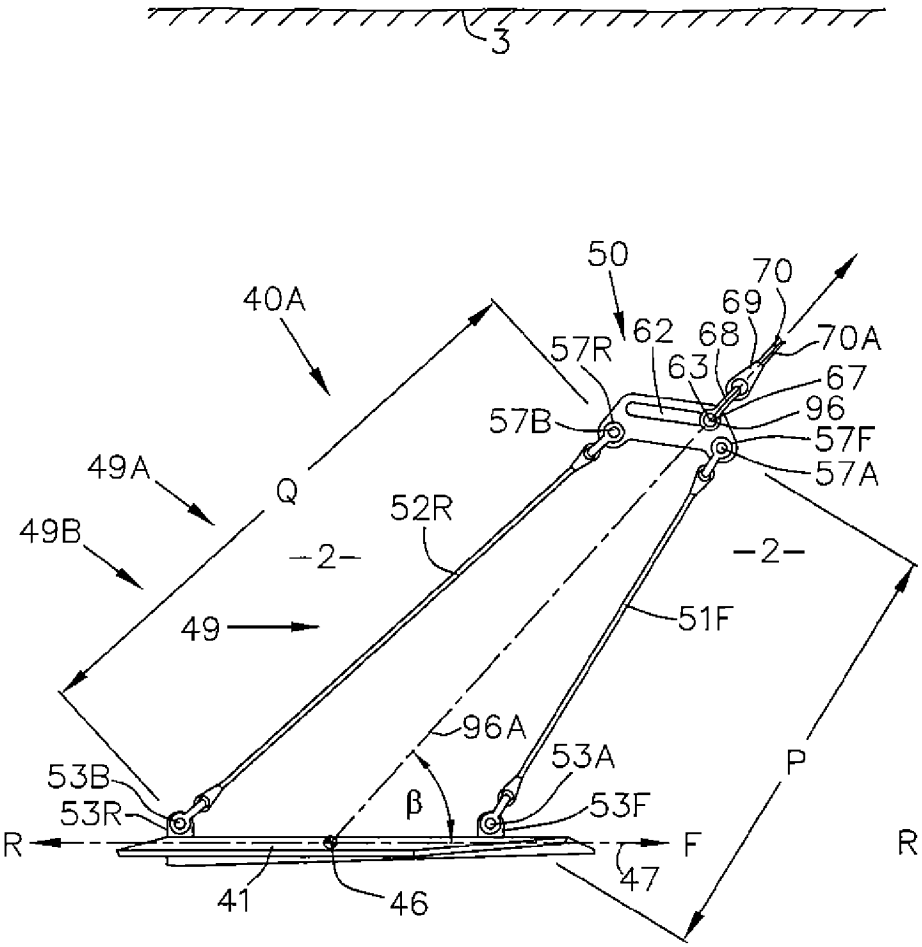
FIG. 14 shows a side view of the anchor of FIG. 5 with a forward-opening preliminary acute angle β.

Referring to FIGS. 14 and 15, if the rearward-burying near normal load mode of operation is not required, for example, in regions where hurricanes do not occur, anchor 40A includes coupling plate 50 and cables 52R, as in anchor 40 (FIGS. 5 and 6), but has cables 51F reduced in length to make distance P about 0.75 times distance Q instead of being equal to distance Q. When pin 67 of shackle 68 is loaded and lodged at first load application point 63 in coupling plate 50, first load application point 63 stabilizes at preliminary stable point 96 as previously described for anchor 40 (FIG. 11). Preliminary stable point 96 defines forward-opening acute angle β. Forward-opening acute angle β is in the range of 54° to 66° with 60° preferred and, as before, is provided to facilitate seabed surface penetration by fluke 41 in soft soils. Distances L, M, and N in coupling plate 50 are selected such that when pin 67 of shackle 68 is loaded and lodged at second load application point 65 of coupling plate 50, second load application point 65 stabilizes at first stable point 74 as previously described for anchor 40 (FIG. 12). First stable point 74 defines forward-opening acute angle A which, as before, in the range of 68° to 82°, with 75° preferred. Anchor 40A thus includes the bi-stable mechanism 49B previously described. When anchor 40A is embedded in soil 2 with pin 67 of shackle 68 held at first stable position 96 for installation, with anchor line 70 inclined to horizontal at seabed surface 3 by up to 25°, and with fluke centroid 46 below seabed surface 3 by more than 2 √A, the bi-stable mechanism 49B may be triggered by increasing the inclination of anchor line 70 to horizontal at seabed surface 3 into the range of 40° to 60° while under tension. This, in turn, increases the inclination of anchor line 70 at shackle 68 and causes shank 69, including cables 51F and 52R and coupling plate 50, to rotate under tension in soil 2. However, as mentioned previously, coupling plate 50 rotates in the opposite sense to the rotation of cables 51F and 52R of shank 49. In consequence, the slope of slot 62 in coupling plate 50 changes progressively to a point where pin 67 of shackle 68 slides from first load application point 63 to second load application point 65 whereby forward-opening acute angle β increases to become forward-opening acute angle A and pin 67 of shackle 68 is held at second stable position 74 (FIG. 15). When anchor line 70 is now pulled at a reduced operational inclination angle at seabed surface 3 typically in the range of 15° to 35°, anchor 40A buries along a steeper trajectory in the before-mentioned "near normal load mode" of anchor operation to provide holding capacity to match the loading in anchor cable 70 up to the point where anchor cable 70 parts. It is noteworthy that, in this arrangement of anchor 40A, the near normal load mode of operation at forward-opening acute angle A, following surface penetration and initial burial at smaller forward-opening acute angle β, is achieved by simply increasing and then decreasing the angle of inclination of anchor line 70 at seabed surface 3 while under tension, without need for parting shear pin 95 in distance adjuster 80 as in the arrangement of anchor 40 shown in FIGS. 11 to 13, and without a need for an auxiliary line hitherto essential to enable a known alternative mechanism to be remotely actuated. This reduces mechanical complexity and increases operational versatility.

Figure 16:
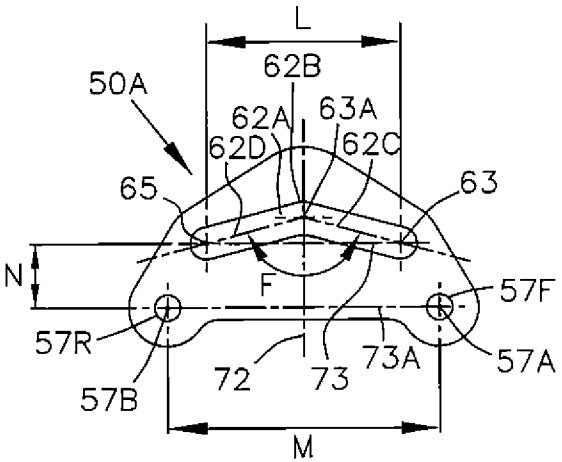
FIG. 16 shows to a larger scale an alternative coupling plate having three load application points.

Referring to FIG. 16, a modified coupling plate 50A, for inclusion in anchor 40A mentioned hereinafter, differs from coupling plate 50 by having a slot 62A which incorporates an intermediate load application point 63A at a bend 62B therein and by being strengthened with increased material above slot 62A to resist bending moment arising when pin 67 of shackle 68 is lodged at and applies loading at intermediate load application point 63A. Intermediate load application point 63A is preferably located equidistant from first load application point 63 and second load application point 65. First load application point 63 and intermediate load application point 63A lie on straight line 62C while second load application point 65 and intermediate load application point 63A lie on straight line 62D. A downward-opening obtuse angle F is included between straight lines 62C and 62D. Obtuse angle F is in a preferred range of 140° to 160° with 150° further preferred. It may be noted that if angle F is chosen to be outside of the preferred range and made equal to 180°, coupling plate 50A effectively becomes identical to coupling plate 50. Coupling plate 50A enables a tri-stable mechanism 49C to be incorporated in anchor 40A.

Figures 17, 18, 19, 20, 21, 22:
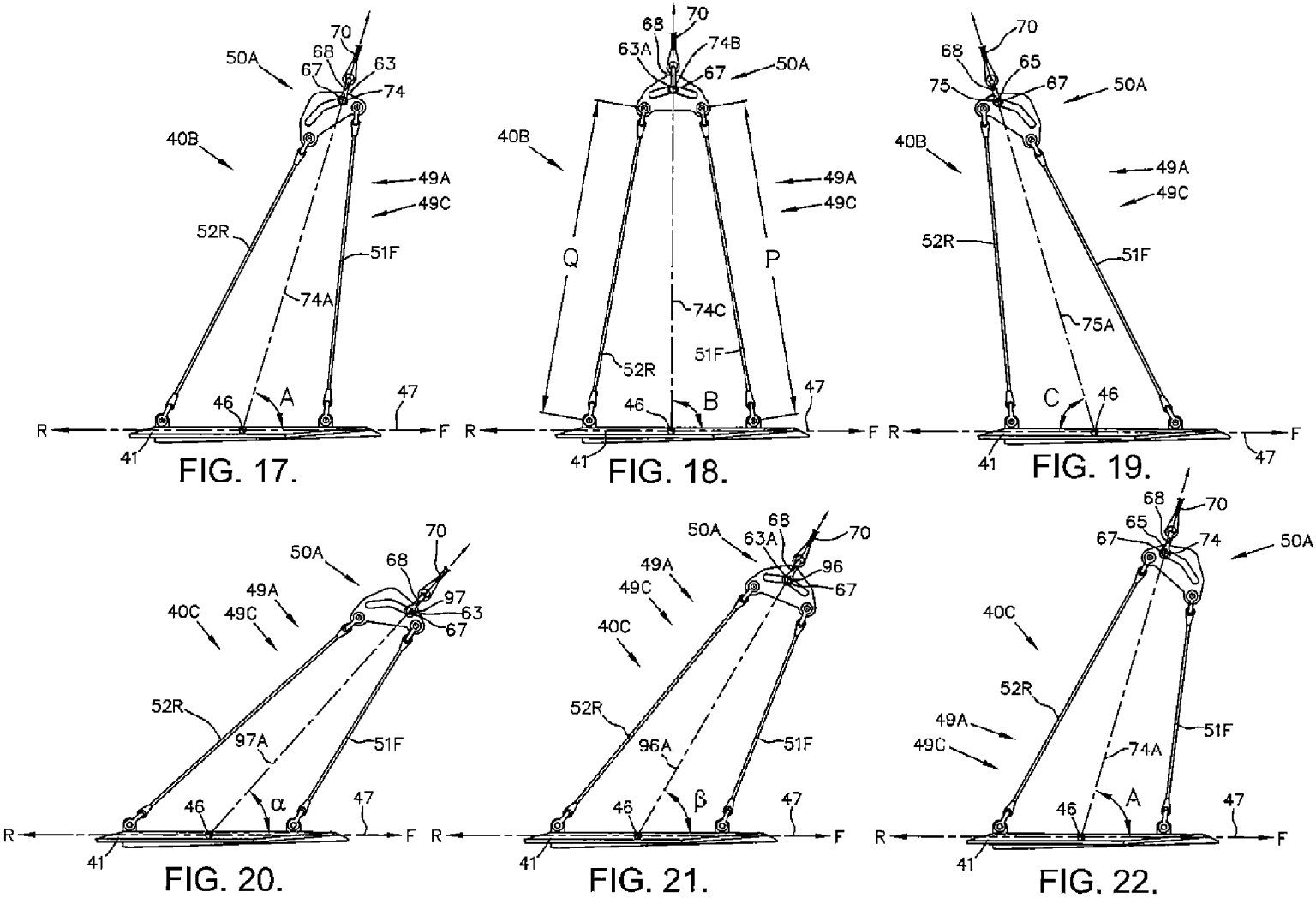
FIG. 17 shows the anchor of FIG. 5 fitted with the coupling plate of FIG. 16 and in a first stable configuration defining angle A.
FIG. 18 shows the anchor of FIG. 17 in an intermediate stable configuration defining angle B.
FIG. 19 shows the anchor of FIG. 17 in a second stable configuration defining angle C.
FIG. 20 shows the anchor of FIG. 18 with P less than Q and in a first initial stable configuration defining angle α.
FIG. 21 shows the anchor of FIG. 20 in a second initial stable configuration defining angle β.
FIG. 22 shows the anchor of FIG. 20 in a first stable configuration defining angle A.

Referring to FIGS. 17 to 19, anchor 40B is a modification of anchor 40 (FIGS. 5 and 6). Anchor 40B includes a tri-stable mechanism 49C by virtue of substituting coupling plate 50A (FIG. 16) for coupling plate 50 (FIGS. 5, 6 and 10). Distance P is equal to distance Q (FIG. 18). Intermediate load application point 63A, in coupling plate 50A, allows utilization of an intermediate stable position 74B (FIG. 18) in anchor 40B, between first stable position 74 (for first load application point 63) and second stable position 75 (for second load application point 65), such that straight line 74C containing intermediate stable position 74B and centroid 46 forms an angle B with reference straight line 47. Angle B is a right angle when cables 51F and 52R are of equal length where distance P equals distance Q. When loading from pin 67 of shackle 68 is applied at intermediate load application point 63A, point 63A stabilizes at intermediate stable position 74B. This permits anchor 40B to function additionally as a vertical load anchor, capable of providing the ultimate in holding capacity when resisting loads applied at right angles to fluke 41 (in what is known as the "vertical load mode" or "normal load mode" of anchor operation), as well as to function in the "near normal load mode" conferred by the use of angles A or C in the ranges mentioned previously wherein almost the full capacity of the vertical load mode is realizable while preserving the ability of anchor 40B to continue burying deeper below seabed surface 3 in forward or rearward directions. In a manner similar to that of the bi-stable mechanism 49B described previously, the tri-stable mechanism 49C may be triggered from first to second to third stable geometrical configuration of anchor 40B, encompassing forward-opening acute angle A, intermediate angle B, and rearward-opening acute angle C respectively, and vice versa, by appropriately and sufficiently changing the inclination of axis 70A of anchor line 70 controlled by an installation vessel.

Referring to FIGS. 20 to 22, anchor 40C is a version of anchor 40B modified further to include a tri-stable mechanism 49C having three forward-opening acute angles α, β, and A obtained by choosing distance P to be about 0.75 times distance Q instead of being equal to distance Q as shown in FIG. 18. In anchor 40C, pin 67 of shackle 68 first lodges at first load application point 63 in coupling plate 50A which stabilizes at first initial stable position 97 defining forward-opening acute angle α (FIG. 20). Pin 67 next lodges at intermediate load application point 63A in coupling plate 50A which stabilizes at second initial stable position 96 defining forward-opening acute angle β (FIG. 21). Finally, pin 67 lodges at second load application point 65 in coupling plate 50A which stabilizes at first stable position 74 defining forward-opening acute angle A (FIG. 22). Angle α is in the range of 35° to 50°, with 42° preferred, for facilitating penetration through seabed surface 3 into a firm soil 2. As before: angle β is in the range of 54° to 66°, with 60° preferred, for facilitating penetration through seabed surface 3 into a soft soil 2; and angle A is in the range of 68° to 82°, with 75° preferred, to provide anchor 40C with near normal load mode capability when centroid 46 of fluke 41 is buried at a depth below seabed surface 3 exceeding 2 √A. Again, the tri-stable mechanism 49C of anchor 40C may be triggered from one stable position to another by increasing and then decreasing the inclination to horizontal at seabed surface 3 of anchor line 70 while under tension. The advantages of arranging tri-stable anchor 40C to have three forward-opening acute angles includes: the capability of successful deployment in firm as well as in soft bottom soils without requiring prior adjustment of the geometry of anchor 40; no requirement for using shear pins; reduced mechanical complexity; and greatly increased operational versatility.

Distance adjuster 80 (FIGS. 11 to 12) may be incorporated into anchor 40B (FIGS. 17 to 19) or into anchor 40C (FIGS. 20 to 22) to realise four separate centroid angles instead of three by suitably choosing distances P and Q. Thus, anchors 40B and 40C thus modified may have any four centroid angles chosen from α, β, A, B, and C to suit particular operational requirements.

For drag embedment installation of an anchor according to the first embodiment of the present invention as shown in FIGS. 1 to 4, anchor 1 has auxiliary shank 20 initially locked rotationally by shear pin 33 and then is lowered from an installation vessel onto seabed surface 3 so that fluke 4 rests thereon with reference straight line 10 horizontal. Anchor line 30 is laid out on seabed surface 3 with sufficient length to remain substantially horizontal near anchor 40 while tension is applied therein by the installation vessel to cause anchor 1 to tip forward until points 11 of flukes 4 penetrate through seabed surface 3 and shackle 28 makes contact there-with. In consequence of a relatively small angle β maintained by shear pin 33, further tensioning causes anchor 1 to penetrate through and then bury wholly below seabed surface 3 to follow a curved burial trajectory in soil 2. A progressively increasing soil reaction force is impressed on fluke 4 as the depth of burial of centroid 9 of fluke 4 increases. A correspondingly increasing moment-induced force is impressed on shear pin 33 due to the moment about load pin 26 of force in anchor line 30 acting along straight line 34 containing preliminary load application point 35 and fluke centroid 9. Shear pin 33 parts when the moment-induced force exceeds the strength of shear pin 33. Auxiliary shank 20 is then free to pivot about load pin 26 which is lodged at first load application point 13 in slot 12 of fluke 4. Thus, the load applied to anchor 1 is transferred from preliminary load application point 35 to first load application point 13. With loading now being applied at the larger forward-opening acute angle A, anchor 1 commences to bury along a steeper trajectory in the before-mentioned near normal load mode of anchor operation wherein much deeper penetration below seabed surface 3 can occur to obtain greatly increased holding capacity. Installation is complete when shear pin 33 has parted and a consequently increased resistance to pulling has allowed a prescribed anchor line tension to be held for 15 to 20 minutes.

For direct embedment installation of anchor 1, auxiliary shank 20 is first removed and pin 28A of shackle 28, linked through socket 29 of anchor line 30, is fitted in slot 12 of shank 7 instead of load pin 26 of shank 20. Anchor 1 is pushed vertically into soil 2 as described in U.S. Pat. No. 6,598,555 using a heavy elongate pile known as a follower which is pivotably and releasably attached to anchor 1. When anchor 1 has been rotated about 45° by reaction against the weight of the follower as the installation vessel cyclically heaves up and pays out anchor line 30 about five times, the elongate follower is removed from anchor 1. Installation is completed by the installation vessel pulling horizontally on anchor line 30 to hold a prescribed test tension for 15 to 30 minutes. Subsequent overloading of anchor line 30 causes anchor 1 to move in forward direction F and follow a steeper near normal load trajectory as described previously whereby anchor 1 can provide holding capacity to match loading in anchor line 30 up to the point where anchor line 30 parts.

In hurricane conditions, when either drag-embedded or direct-embedded anchor 1 is subjected to over loading with a substantial component of load being out of plane of symmetry 6, anchor 1 will veer in soil 2 assisted by anhedral angle E of flukes 4 to bring plane of symmetry 6 into the direction of loading while burying deeper to produce holding capacity to match hurricane loading in anchor line 30 up to the point where anchor line 30 parts. However, when anchor line 30 remains in plane of symmetry 6 and is pulled rearward over anchor 1, either load pin 26 of auxiliary shank 20 or pin 28A of shackle 28 is pulled rearward and slides in slot 12 to lodge at second load application point 15 and so pulls anchor 1 rearward. Anchor 1 simultaneously rotates in soil 2 in plane of symmetry 6 due to the presence of a moment arm comprising distance H separating second load application point 15 from centroid 9 of flukes 4. Rotation is assisted by soil forces on deflector plates 36. Continued pulling causes anchor 1 to commence burying deeper in rearward direction R in the near normal load mode of operation to produce holding capacity to match hurricane loading in anchor line 30 up to the point where anchor line 30 parts. Thus, when deployed at multiple locations around an offshore exploration or production platform, anchor 1 is capable of providing holding capacity in any azimuthal direction of loading sufficient to part attached anchor line 30 so that dragging of anchor 1 into a nearby pipeline does not occur.

When anchor 1 has not been pulled rearward in hurricane conditions, anchor 1 may be recovered in the azimuthal direction of the installed anchor line 30 simply by heaving up on anchor line 30 at an inclination at seabed surface 3 in the range 60° to 80° and maintaining tension in anchor line 30 by pulling horizontally thereon with a recovery vessel until anchor 1 moves along an upward-inclined path back to seabed surface 3. When anchor 1 has been pulled rearward, this recovery procedure is carried out in the opposite azimuthal direction.

For drag embedment installation of an anchor according to the second embodiment of the present invention as shown in FIGS. 5 to 9 and 11 to 13, anchor 40 is equipped with distance adjuster 80 in which shear pin 95 is fitted (FIG. 11). Anchor 40 is lowered from an installation vessel onto seabed surface 3 by means of anchor line 70 so that fluke 41 comes to rest thereon with reference straight line 47 horizontal. The installation vessel then moves slowly forward at a speed of about one knot while paying out anchor line 70 at the same speed. This lays anchor line 70 without tension on seabed surface 3. The installation vessel then stops both moving forward and paying out anchor line 70 when the length of anchor line 70 outboard is calculated to provide an angle of inclination of anchor line 70 at seabed surface 3 of between 15° and 25° to horizontal at final installation tension. This minimises installation time in deep water. On commencing installation pulling, anchor line 70 adjacent to anchor 40 lies horizontally on seabed surface 3. Tension in anchor line 70 causes pin 67 of shackle 68 to slide in slot 62 of coupling plate 50 to lodge at first load application point 63 therein. This, in turn, exerts a forward-directed force via rear cables 52R on rear lugs 53B of fluke 41 while forward cables 51F remain slack. The line of action of force in rear cables 52R applied to upstanding lugs 53B has a small moment about centroid 46 which, together with soil resistance at fluke points 48, causes fluke 41 to tip up and penetrate through seabed surface 3 at a small angle of inclination to horizontal. As penetration progresses, fluke 41 tips up further until cables 51F become taut as well as cables 52R and first load application point 63 is held at preliminary stable position 96 which defines preliminary forward-opening acute centroid angle β which is smaller than forward-opening acute centroid angle A (FIG. 11). Angle β, being relatively small, prevents anchor 40 from pulling out of soil 2 while fluke 41 is in close proximity to seabed surface 3 by failing a wedge of soil above fluke 41. Further pulling on anchor line 70 causes anchor 40 to penetrate deeper along an inclined path below seabed surface 3. At a certain depth of penetration of fluke centroid 46 below seabed surface 3, soil reaction load on fluke 41 induces sufficient tension in cables 51F to part shear pin 95 in distance adjuster 80 to allow elongated plates 81 and 88 to swing into alignment with each other and to cause distance P−(S−T) to increase to P and cause shank 49 to rotate relative to fluke 41 to move first load application point 63 from preliminary stable position 96 to first stable position 74 which defines larger forward-opening acute centroid angle A (FIGS. 11 and 12). The parting strength of shear pin 95 is chosen to allow centroid 46 of fluke 41 to reach a depth below seabed surface 3 exceeding 2 √A before shear pin 95 parts, where A is the total area of plates 42 and 43 plus the area of deflector plate 76 seen in plan view (FIG. 9). Further pulling causes anchor 40 to follow a steeper near normal load trajectory as described previously. When a prescribed installation tension is reached, the scope of anchor line 70 is adjusted to bring anchor line 70 to an operational angle of inclination to horizontal at seabed surface 3 of typically between 15° and 35°. The prescribed installation tension is then maintained for 15 to 30 minutes by way of final testing of the installation prior to connecting to a structure to be moored.

In hurricane conditions, when drag-embedded anchor 40 is deeply embedded in the near normal load mode and subjected to overloading with a substantial component of load out of plane of symmetry 45, anchor 40 will veer in soil 2, assisted by anhedral angle E of fluke plates 43, to bring plane of symmetry 45 into the direction of loading while burying deeper to provide holding capacity to match hurricane loading in anchor line 70 up to the point where anchor line 70 parts.

However, when anchor line 70 remains in plane of symmetry 45 and is pulled rearward over anchor 40, the inclination to horizontal of the loading direction at shackle 68 increases and triggers the bi-stable mechanical system of anchor 40, as hereinbefore described, whereby shank 49 automatically reconfigures geometrically such that pin 67 of shackle 68 moves in slot 62 of coupling plate 50 to lodge at second load application point 65 which, in turn, moves to second stable position 75 (FIG. 13) to establish rearward-opening acute centroid angle C. Continued pulling causes anchor 40 to rotate and commence burying deeper in rearward direction R in the near normal load mode of operation to produce holding capacity to match hurricane loading in anchor line 70 up to the point where anchor line 70 parts. Thus, as for anchor 1, when deployed at multiple locations around an offshore exploration of production platform, anchor 40 is capable of providing holding capacity in any azimuthal direction of loading sufficient to part anchor line 70 so that dragging of anchor 40 into a pipeline does not occur.

If anchor 40 has not been pulled rearward in hurricane conditions, anchor 40 may be recovered in the azimuthal direction of installation simply by heaving up on anchor line 70 at an inclination to horizontal at seabed surface 3 in the range of 60° to 80° and maintaining tension in anchor line 70 by pulling horizontally thereon with a recovery vessel until anchor 70 moves along an upward-inclined path back to seabed surface 3. If anchor 70 has been pulled rearward, this latter recovery procedure is carried out in the opposite azimuthal direction.

For drag embedment installation of an anchor according to a first modification of the second embodiment of the present invention as shown in FIGS. 14 and 15, anchor 40A is deployed on seabed surface 3 and embedded in soil 2 in the same manner as for anchor 40, described previously, up to the point where shear pin 95 in distance adjuster 80 of anchor 40 would be about to part. At this point, tension in anchor line 70 measured at the installation vessel reaches a prescribed value. Tension is then reduced to allow shortening of the scope of anchor line 70 such that, when tension is restored, the angle of inclination to horizontal at seabed surface 3 of anchor line 70 has been increased by some 20° to 30°. This increases the inclination of axis 70A of anchor line 70 at shackle 68 attached to embedded anchor 40A sufficiently to trigger the bi-stable mechanism 49B of anchor 40A to cause shank 49 to rotate relative to fluke 41 to move first load application point 63 from preliminary stable position 96 to first stable position 74 which defines larger forward-opening acute centroid angle A (FIG. 15). Tension in anchor line 70 is then reduced again and the scope of anchor line 70 is increased to a scope calculated to produce an inclination to horizontal of anchor line 70 at seabed surface 3 to between 15° and 25° at final installation tension. Further pulling causes anchor 40A to follow a steeper near normal load trajectory as described previously. When the final installation tension is reached, the scope of anchor line 70 is recalculated and adjusted to bring anchor line 70 to an operational angle of inclination to horizontal at seabed surface 3 of between 15° and 35° at a prescribed test tension. The prescribed test tension is then maintained for 15 to 30 minutes by way of final proving of the installation prior to connecting to a structure to be moored. Recovery of anchor 40A is accomplished by using the same procedure as for anchor 40.

For drag embedment installation of an anchor according to a second modification of the second embodiment of the present invention as shown in FIGS. 17 to 19, anchor 40B is fitted with distance adjuster 80 as for bi-stable anchor 40 shown in FIGS. 11 to 13. Thus fitted, anchor 40B is installed in the same manner as described for anchor 40 and also functions in hurricane conditions as described for anchor 40. However, the presence of intermediate stable position 63A in the tri-stable mechanism 49C of anchor 40B provides an option to operate anchor 40B as a normal load anchor by locating pin 67 of shackle 68 at intermediate load application point 63A in coupling plate 50B by appropriate manipulation of the inclination to horizontal of anchor line 70 at seabed surface 3 as previously described. Anchor 40B can then be used in applications requiring anchor line 70 to resist high loading when pulled vertically. Recovery procedure for anchor 40B is similar to that of anchor 40 with the exception that, when anchor 40B has been operated in the vertical load mode, anchor line 70 must first be paid out to establish long scope and then pulled to move pin 67 of shackle 68 from intermediate load application point 63A to first load application point 63 before commencing the recovery procedure.

For drag embedment installation of an anchor according to a third modification of the second embodiment of the present invention as shown in FIGS. 20 to 22, the procedure used is the same as that for anchor 40A previously described with reference to FIGS. 14 and 15. Recovery procedure for anchor 40C is similar to that of anchor 40 with the exception that anchor line 70 must first be paid out to establish long scope and then pulled to move pin 67 of shackle 68 from second load application point 65 or from intermediate load application point 63A to first load application point 63 in coupling plate 50A before commencing the recovery procedure.

Further modifications of the anchors herein described are, of course, possible within the scope of the present invention. For example, the magnitudes of the angles α and β in anchors 1 and 40, 40A, 40B and 40C may be chosen to be outside of the above-noted ranges for particular applications and elongate members 51F and 52R may be rigid beams.

The invention claimed is:

1. An anchor for embedment in a soil below a seabed surface comprising:

a fluke member having substantially planar upper surfaces which bear on said soil when said is subjected to loading therein, said planar upper surfaces having a centroid located in a plane of symmetry of said anchor;

a shank member;

at least two load application points for attachment of a connecting member for connecting said anchor to an anchor line; and a passageway for enabling said connecting member to be transferred between said load application points such that said load application points lie on a substantially straight line which contains the centroid of said planar upper surfaces and forms an angle of inclination with a reference straight line of said anchor, located in said plane of symmetry and parallel to said planar upper surfaces, said reference straight line containing said centroid and defining a forward and a rearward direction of said anchor, and such that said passageway is fixed angularly with respect to said reference straight line, characterised in that said angle of inclination is a forward-opening acute angle with respect to a first load application point and a rearward-opening acute angle with respect to a second load application point whereby loading applied by said anchor line via said connecting member to said anchor at a load application point causes said anchor to bury deeper below said seabed surface in a forward direction with respect to said first load application point and in a rearward direction with respect to said second load application point.

2. An anchor, according to claim 1, wherein said forward-opening acute angle has a value in the range of 68° to 82, and said rearward-opening acute angle has a value in the range of 68° to 82°.

3. An anchor according to claim 1, wherein said passageway is configured to receive said connecting member such that said connecting member may be transferred between a first load application point and a second load application point by moving in said passageway.

4. An anchor according to claim 1, wherein said first and second load application points are each separated from said centroid by a distance in the range of 0.12 to 0.4 times the square root of the plan area of said planar upper surfaces of said fluke member.

5. An anchor according to claim 1, wherein said first load application point is separated from said second load application point by a distance in the range of 0.03 to 0.3 times the square root of the plan area of said planar upper surfaces of said fluke member.

6. An anchor according to claim 1, wherein said connecting member comprises an elongate auxiliary shank member including a clevis at a lower end of the connecting member for attachment by means of a load pin to said shank member and a preliminary load application point at an upper end of the connecting member for attaching an anchor line.

7. An anchor according to claim 6, wherein a shearable pin is provided between said shank member and said auxiliary shank member to hold temporarily said preliminary load application point on a straight line containing said centroid, which is inclined to said reference straight line to form a forward-opening angle in the range of 52° to 68°.

8. An anchor according to claim 1, wherein a deflector plate is provided at the rear of said fluke member including a rearward-facing upper surface, located at each side of said plane of symmetry of said anchor, and located in a plane intersecting said plane of symmetry in a line forming an angle of inclination of said rearward-facing upper surface relative to said reference straight line whereby said rearward-facing upper surface produces a deflection force from soil interaction thereon to facilitate rotation of said anchor in said soil when a rearward-directed component of force is applied to said second load application point.

9. An anchor, according to claim 8, wherein said angle of inclination of said rearward-facing upper surface is in the range of 10° to 40°.

10. An anchor according to claim 8, wherein the ratio of the area of said rearward-facing upper surface to the total area of said planar upper surfaces is in the range of 0.02 to 0.2.

11. An anchor for embedment in a soil below a seabed surface, comprising:

a fluke member including plates having substantially planar upper surfaces which bear on said soil when said anchor is subjected to loading therein said planar upper surfaces having a centroid located in a plane of symmetry of said anchor;

a shank member including at least two pivotable elongate members and a coupling member serving to couple said elongate members distal from said fluke member; and a load application point for attachment of a connecting member for connecting said anchor to an anchor line, such that said load application point lies on a substantially straight line which contains said centroid of said planar upper surfaces and forms a centroid angle of inclination with a reference straight line of said anchor located in said plane of symmetry and parallel to said planar upper surfaces, said reference straight line containing said centroid and defining a forward and a rearward direction of said anchor, said elongate members being of length such as to maintain said coupling member clear of said fluke member when said anchor is subjected to loading by said anchor line, said elongate members being attached to said fluke member at attachment points such that projections of said attachment points on said plane of symmetry are spaced apart, said elongate members being attached to said coupling member at attachment points spaced apart on said coupling member, characterised in that said coupling member includes said at least two load application points and a passageway configured for enabling said connecting member, when attached to said coupling member, to be transferred between said load application points by moving in said passageway such that said anchor comprises a multi-stable mechanism, operable by said anchor line, whereby said connecting member may be moved reversibly between at least two stable positions of location of a load application point.

12. An anchor according to claim 11, wherein two forward pairs of said elongate members and two rearward pairs of said elongate members are provided and are of lengths such that said stable positions are located at a distance from said centroid of said planar upper surfaces of said fluke member, which planar upper surfaces bear on said soil when said anchor is subject to loading therein, said distance being in the range of 0.5 to 1.65 times the square root of the plan area of said planar upper surfaces.

13. An anchor according to claim 11, wherein said centroid angle of inclination relating to each of two adjacent stable positions is selected to be in a different one of five ranges: three forward-opening ranges comprising 36° to 52°, 52° to 68°, and 68° to 82°, one intermediate range of 85° to 95°; and one rearward-opening range of 68° to 82°.

14. An anchor according to claim 11, wherein said coupling member comprises a planar member including said passageway comprising a slot, two spaced attachment points for attaching said elongate members, and said first load application point and said second load application point each located in and adjacent to an end of said slot.

15. An anchor according to claim 14, wherein said first and second load application points are separated by a first distance which is less than a second distance separating said two spaced attachment points.

16. An anchor according to claim 15, wherein the ratio of said second distance to said first distance is in the range of 1 to 3.

17. An anchor according to claim 15, wherein a first straight line containing said first and second load application points is parallel to a second straight line containing said two spaced attachment points, said first and second straight lines being separated by a distance in the range of zero to 0.5 times said second distance.

18. An anchor according to claim 14, wherein said multi-stable mechanism comprises a bi-stable mechanism wherein said coupling member includes a straight slot containing first and second load application points locatable at corresponding first and second stable positions, said first and said second stable positions defining respectively a forward-opening acute centroid angle and a rearward-opening acute centroid angle each in the range of 68° to 82°.

19. An anchor according to claim 14, wherein said multi-stable mechanism comprises a bi-stable mechanism wherein said coupling member includes a slot containing first and second load application points locatable at corresponding first and second stable positions, said first and said second stable positions defining respectively a first forward-opening acute centroid angle in the range of 52° to 68°, and a second forward-opening acute angle in the range of 68° to 82°.

20. An anchor according to claim 14, wherein said slot in said coupling member has a bend therein serving to provide an intermediate load application point between said first and second load application points with axes of said slot at each side of said bend forming an included downward-opening obtuse angle in the range of 140° to 160°.

21. An anchor according to claim 20, wherein said multi-stable mechanism comprises a tri-stable mechanism wherein said coupling member includes a bent slot containing first and second load application points locatable at corresponding first and second stable positions, said first and said second stable positions defining respectively a forward-opening acute centroid angle and a rearward-opening acute centroid angle each in the range of 68° to 82°, and containing an intermediate load application point locatable at an intermediate stable position defining one of a forward-opening acute centroid angle and a rearward-opening acute centroid angle each in the range of 85° to 90°.

22. An anchor according to claim 20, wherein said multi-stable mechanism comprises a tri-stable mechanism wherein said coupling member includes a bent slot containing first and second load application points locatable at corresponding first and second stable positions said first stable position defining a first forward-opening acute centroid angle in the range of 36° to 52°, said second stable position defining a second forward-opening acute centroid angle in the range of 68° to 82°, and containing an intermediate load application point locatable at an intermediate stable position defining an intermediate forward-opening centroid angle in the range of 52° to 68°.

23. An anchor according to claim 20, wherein said multi-stable mechanism comprises a tri-stable mechanism wherein said coupling member includes a bent slot containing first and second load application points locatable at corresponding first and second stable positions, said first stable position defining a forward-opening acute centroid angle in the range of 52° to 68°, said second stable position (75) defining a rearward-opening acute centroid angle in the range of 68° to 82°, and containing an intermediate load application point locatable at an intermediate stable position defining an intermediate forward-opening acute centroid angle in the range of 68° to 82°.

24. An anchor according to claim 14, wherein a distance adjuster is provided in said shank member for altering temporarily the distance between an attachment point on said coupling member for at least one of said elongate members and a corresponding attachment point on said fluke member to provide a preliminary stable position for said first load application point whereby a straight line containing said first load application point and said centroid forms with said reference straight line a preliminary forward-opening acute angle in one of the range of 36° to 52°,and the range of 52° to 68°, when said anchor line is tensioned.

25. An anchor according to claim 24, wherein said distance adjuster comprises two hingedly-connected elongate elements, with attachment points thereon for attachment between a forward attachment point on said coupling member and a corresponding attachment point on said fluke member, whereby said elements provide minimum or maximum separation of said attachment points when closed or opened respectively.

26. An anchor according to claim 25, wherein a shearable in is provided between said elements to hold said elements temporarily together with said attachment points at minimum separation.

27. An anchor according to claim 11, wherein a deflection plate is provided at the rear of said fluke member including a rearward-facing upper surface, located at each side of said plane of symmetry of said anchor, and located in a plane intersecting said plane of symmetry in a line forming an angle of inclination of said rearward-facing upper surface relative to said reference straight line whereby said rearward-facing upper surface produces a deflection force from soil interaction thereon to facilitate rotation of said anchor in said soil when a rearward-directed component of force is applied to said second load application point.

28. An anchor, according to claim 27, wherein said angle of inclination of said rearward-facing upper surface is in the range of 10° to 40°.

29. An anchor according to claim 28, wherein the ratio of the area of said rearward-facing upper surfaces to the total area of said planar upper surfaces is in the range of 0.02 to 0.2.

* * * * *